United States Patent [19]

Yang et al.

[11] Patent Number: 4,907,312

[45] Date of Patent: Mar. 13, 1990

[54] BRIDGE AND METHOD OF INSTALLING PREFABRICATED BRIDGES AND BRIDGE STRUCTURE

[75] Inventors: Y. C. Yang, San Francisco; Philip Y. Chow, Orinda, both of Calif.

[73] Assignee: T. Y. Lin International, San Francisco, Calif.

[21] Appl. No.: 285,079

[22] Filed: Dec. 16, 1988

[51] Int. Cl.[4] ..... E01D 11/00

[52] U.S. Cl. ..... 14/21; 14/1

[58] Field of Search ..... 14/1, 18, 20, 21, 23, 14/75, 77

[56] References Cited

U.S. PATENT DOCUMENTS

| | | | |
|---|---|---|---|
| 3,259,932 | 7/1966 | Patin | 14/18 |
| 3,685,074 | 8/1972 | Marshall et al. | 14/18 |
| 3,975,476 | 8/1976 | Finsterwalder | 14/23 |
| 3,978,630 | 9/1976 | Labie et al. | 52/745 |
| 4,301,565 | 11/1981 | Weinbaum | 14/1 |
| 4,513,465 | 4/1985 | Schambeck | 14/18 |
| 4,662,019 | 5/1987 | Muller | 14/1 |

*Primary Examiner*—Jerome W. Massie, IV
*Assistant Examiner*—Gay Ann Spahn
*Attorney, Agent, or Firm*—Owen, Wickersham & Erickson

[57] ABSTRACT

A bridge and a method of constructing the bridge over water. A bridge span is positioned longitudinally in portion through a slot in a bridge pier; then the span is moved laterally through the slot to a position in the center of the pier at a low level. Then the span is hoisted up to its correct position. The hoisting step may be preceded by or may include placing jacks under the span and directly above the bottom of the pier and then employing the jacks in the hoisting step. The bridge or bridge segment comprises a pair of pier portions with a span-accepting slot, between them, each pier portion comprising an underwater footing and a vertical pier portion resting on, secured to, and rising from the footing to a deck-support platform. The bridge has a deck extending through the slot and centered with respect thereto, a pair of towers on opposite sides of the deck at its midpoint for resting on the support platforms, and a series of span-supporting cables secured to the towers at their upper ends and to the span's deck at their lower ends. The span can be prefabricated, transported by a barge having a longitudinal axis, along a body of water, to a locus adjacent the bridge site, inserted through the slot in the pier and centered relatively to the pier portions; then it can be raised up so that the towers rest on the pier portions, and the span is secured to the pier portions with the deck at the proper level.

13 Claims, 6 Drawing Sheets

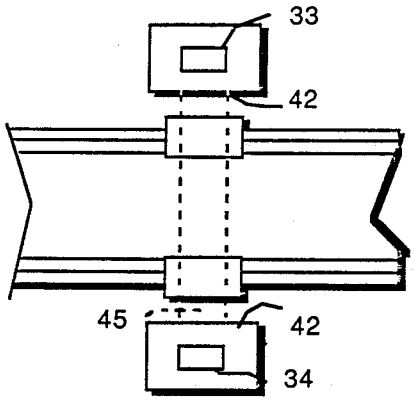
FIG. 9
FIG. 10
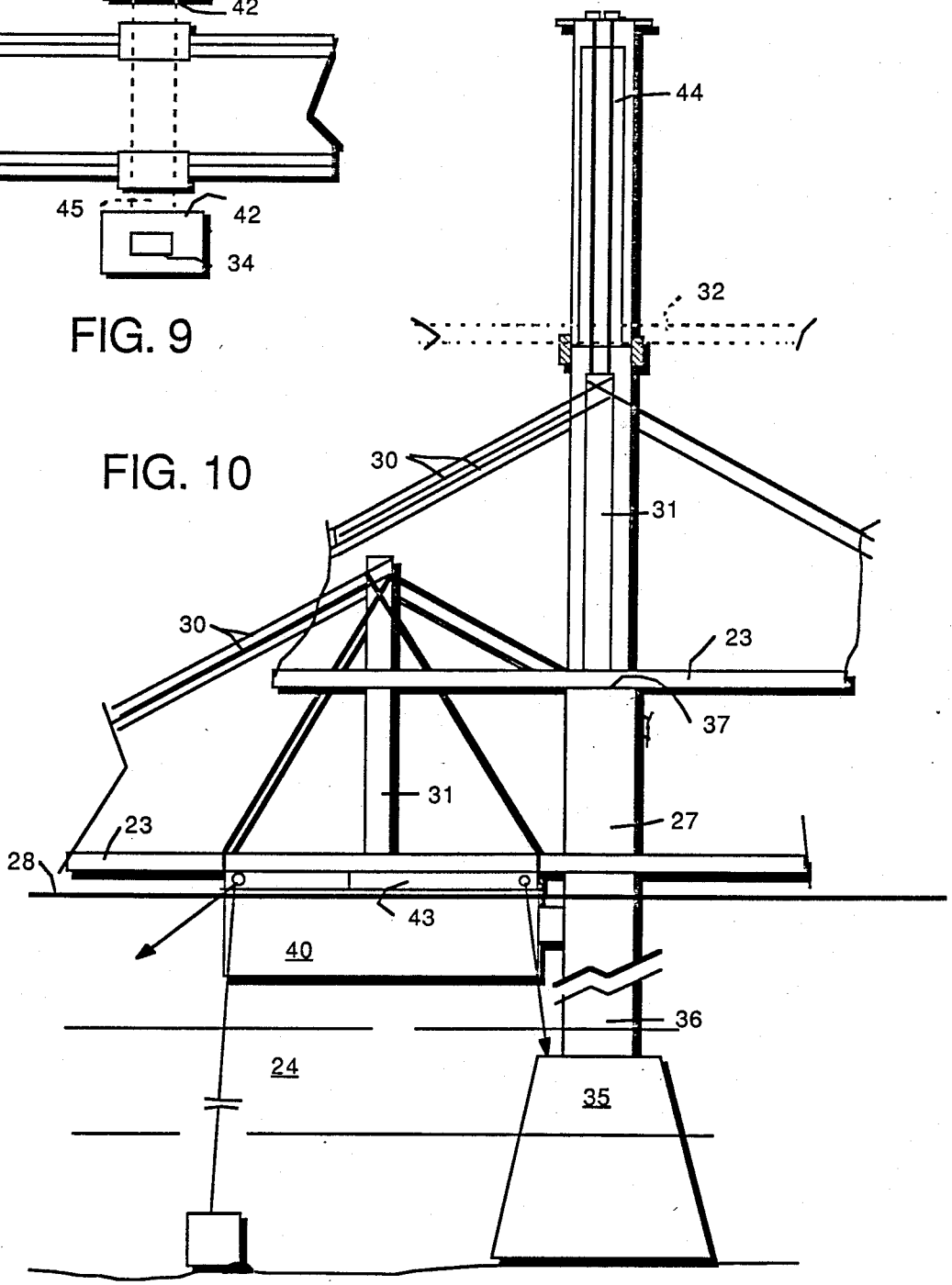

BRIDGE AND METHOD OF INSTALLING PREFABRICATED BRIDGES AND BRIDGE STRUCTURE

This is invention relates to a bridge and to a method for installing prefabricated bridges. It may be called the slotted pier method.

BACKGROUND OF THE INVENTION

The invention concerns the installation of large bridge sections, or even the entire pre-completed bridge, on a pier or piers at a high level above the water.

Hitherto, such bridges had to be built in manageable small sections and hoisted piece-by-piece by cranes from a supply barge or barges floating below the bridge. An alternative method was to install a new span by launching it from a completed span, if the new span was not too large.

Heretofore, hoisting the whole bridge or a complete span from outside the piers has been avoided because of problems caused by hoisting the bridge or complete span eccentrically from one side and by having to move the bridge or span laterally to the central position on the pier on a higher level.

An object of the invention is to enable a bridge to be positioned longitudinally in the central position through a slot provided in the bridge pier, and then to be moved laterally to a position in the center of the pier at low level. Then the pier is hoisted up by jacks placed directly over the top of the pier.

SUMMARY OF THE INVENTION

At a bridge site across a body of water, a bridge pier is erected. The pier is composed of two vertical portions, with a span-accepting slot between them. Each pier portion comprises an underwater footing and a vertical pier portion resting on, secured to, and rising from the footing to a deck-support platform.

Meanwhile, at a locus distant from the bridge site along the same body of water, a complete span is made. The span has a deck adapted to fit through the pier's slot, a pair of towers on opposite sides of the deck at its midpoint for eventually resting on the support platforms of the pier, and a series of span-supporting cables secured to the tower at their upper ends and to the span's deck at their lower ends.

When these two operations have been completed, (and possibly while additional piers are constructed at the bridge site and additional spans are being made) the completed span is transported by barge along the body of water to a locus adjacent the bridge site. During transport, the completed span is aligned with and centered on the longitudinal axis of the barge. The span may, upon arrival at the bridge site, be swung around 90° for lateral alignment with the barge. The barge and span are then maneuvered so that the span is aligned with the slot of said pier.

The method continues by inserting the span through the slot of the pier, using the barge for pushing the span further along the slot to center the span relative to the pier, jacking the span up above the deck-support platform, inserting cross girders at the deck level and underneath the span, and then lowering the span to rest on the cross girders, and securing the span to the pier with the deck at the proper level. The spaces or gaps between the ends of the spaces and an adjacent span may be filled in with short designed mid-span portions to bridge the gap.

For plural-span bridges, additional slotted piers and pre-fabricated spans are made and are similarly installed.

BRIEF DESCRIPTION OF THE DRAWINGS

FIG. 9 is an enlarged fragmentary top plan view showing the right hand span as in FIG. 8.

FIG. 10 is an enlarged fragmentary and diagrammatic view in side elevation of the bridge with the new span shown (1) raised on skid girders and corresponding in position to FIG. 9, and (2) centered longitudinally of the pier and being elevated, as going from the broken-line position of FIG. 7 to the FIG. 8 position.

DESCRIPTION OF A PREFERRED EMBODIMENT

Figure 1:
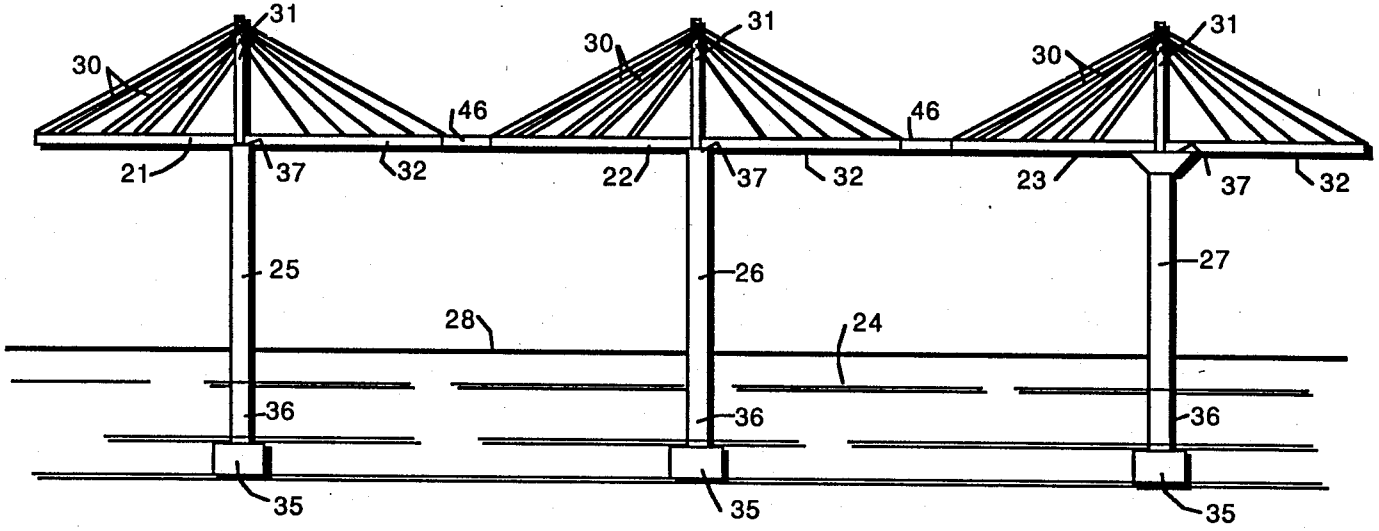
FIG. 1 is a fragmentary view in side elevation of the central portion of a completed bridge embodying the principles of the invention and having three vertical piers.

FIG. 1 shows a portion of a multi-span bridge that has been constructed according to the principles of the invention. The bridge 20 includes a plurality of spans 21, 22, and 23 supported in a body of water 24 by slotted piers 25, 26, and 27, which go down into the water 24. The water 24 is usually shallow for this type of construction. The piers 25, 26, and 27 project well above the top surface 28 of the water 24. In bridges 20 of the type shown, a series of cables 30 go from a tower portion 31 of each span 21, 22, and 23 to a deck 32 of the span.

To explain the construction method of the invention FIGS. 2–12 will be used.

Figure 2:
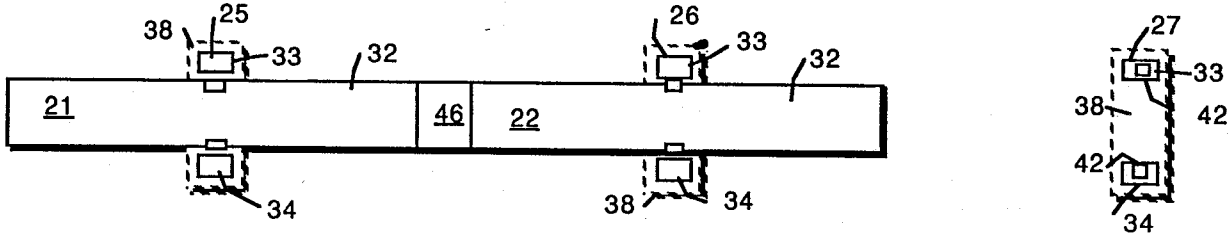
FIG. 2 is a diagrammatic top plan view of the bridge at an early stage of construction, when three piers have been constructed and two spans have been placed on two piers, with a third pier having an empty slot before installation of a third span.

FIG. 2 shows a relatively early stage of construction. All three of the slotted piers 25, 26, and 27 have been constructed, and two of the spans 21 and 22 are in place, having been put there by methods similar to that which is about to be described for bringing the span 23 into position.

As shown in FIGS. 1 and 2, each pier 25, 26, and 27 is a slotted pier having two vertical pier portions 33 and 34. The pier portions 33, 34 are joined into a single pier 36 at a predetermined level just above the low-water level. The combined piers 36 extend up from footing 35, and the pier portions 33,34 extend up to a pile cap platform 37. Each pier 25, 26, and 27 and the combined piers 36 also have and are surrounded by a fender structure 38 (See FIGS. 2, 5, 6, and 8) to protect it from barges, boats, and other things that may float along the body of water 24.

A new span 23, complete with towers 31, cables 30, and deck 32, though not so shown in this view, is made at a waterfront site close to the body 24 of water. The new span 23 is basically complete. It is then (See FIG. 4, left side) loaded on a barge 40 and is longitudinally centered and aligned thereon as well as being laterally centered.

Figure 4:
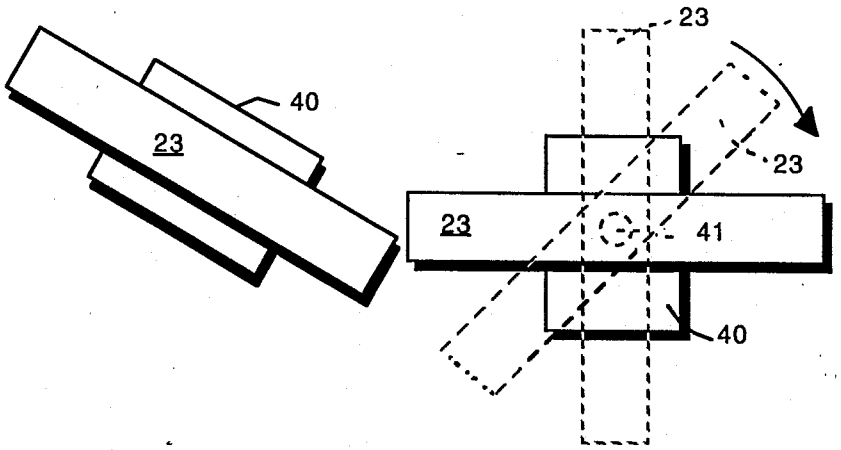
FIG. 4 is a diagrammatic top plan view showing a barge carrying a new span, which is shown in three different positions: (1) at the left, the span is placed upon and aligned longitudinally to a barge that is being floated along the stream or other body of water as it approaches the completed portion of the bridge, (2) at the right and in solid lines, the span is shown on the barge after the barge has been brought into a position to one side of and in between the two completed spans and parallel to the center line of the bridge, and (3) at the right and in broken lines, the new span is swung around on the barge in order to minimize the distance that the span has to be moved from the barge to the center of the pier.

The new span 23 is then, towed to a location near to the partially completed bridge, as shown in FIG. 4, right side. There, the barge 40 is brought to a position where it is approximately perpendicular to the centerline of the bridge 10. At this point, the span 23 is swung on the barge 40 by exactly 90° to bring it into a position parallel to or in line with the completed spans 21 and 22. To make this swinging easier, the barge 40 may be furnished with a swivel member 41.

Figure 5:
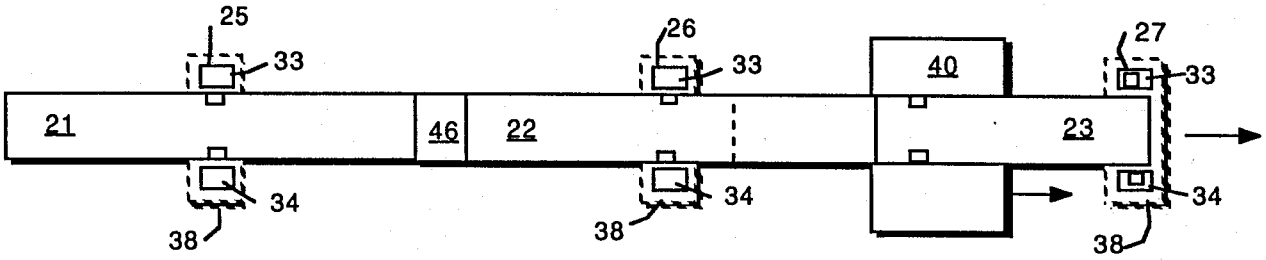
FIG. 5 is a similar view showing the barge as used to bring the new span into centered alignment with the slot through the third pier, to which pier the span is to be affixed and with the span extending into the slot. Part of the new span lies below the left-hand installed spans.

Then, the barge 40 is moved forward to the FIG. 5 position so that the span 23 is, first, in approximate alignment with the slot 42 of its pier 27. Then the barge 40 is so negotiated that the span 22 enters that slot 42.

Figure 3:
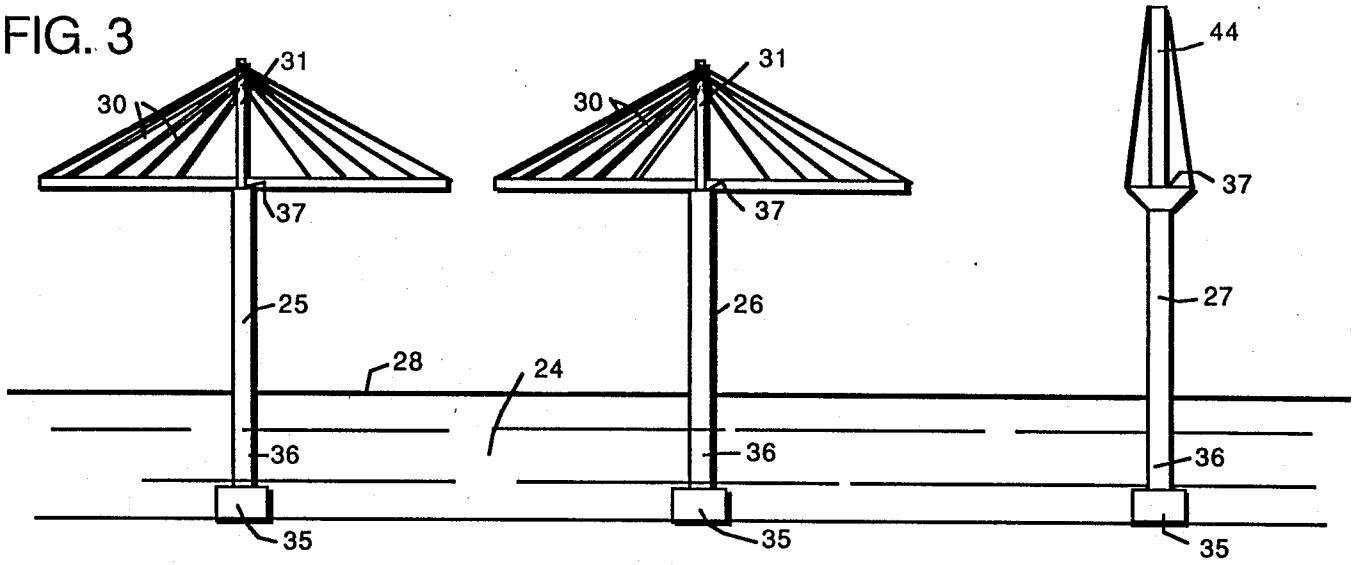
FIG. 3 is a diagrammatic view in side elevation of the bridge at the same stage of construction as FIG. 2, except for the addition of a jacking assembly on top of the third pier and beneath the span.
Figure 6:
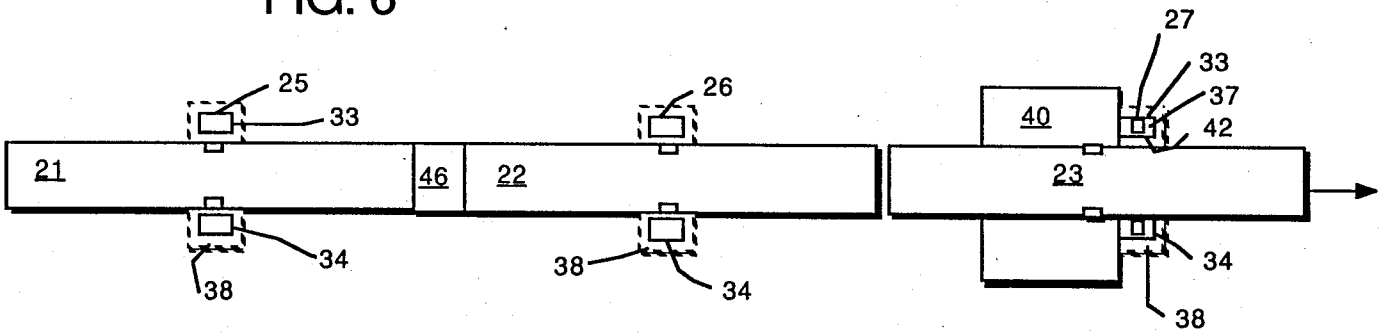
FIG. 6 is a view similar to FIG. 5, with the barge moved against the fenders of the third pier to bring the span further into the slot. At this point, also, the jacking structure is erected, and the third span pushed forward to center it relatively to the slotted third pier.
Figure 7:
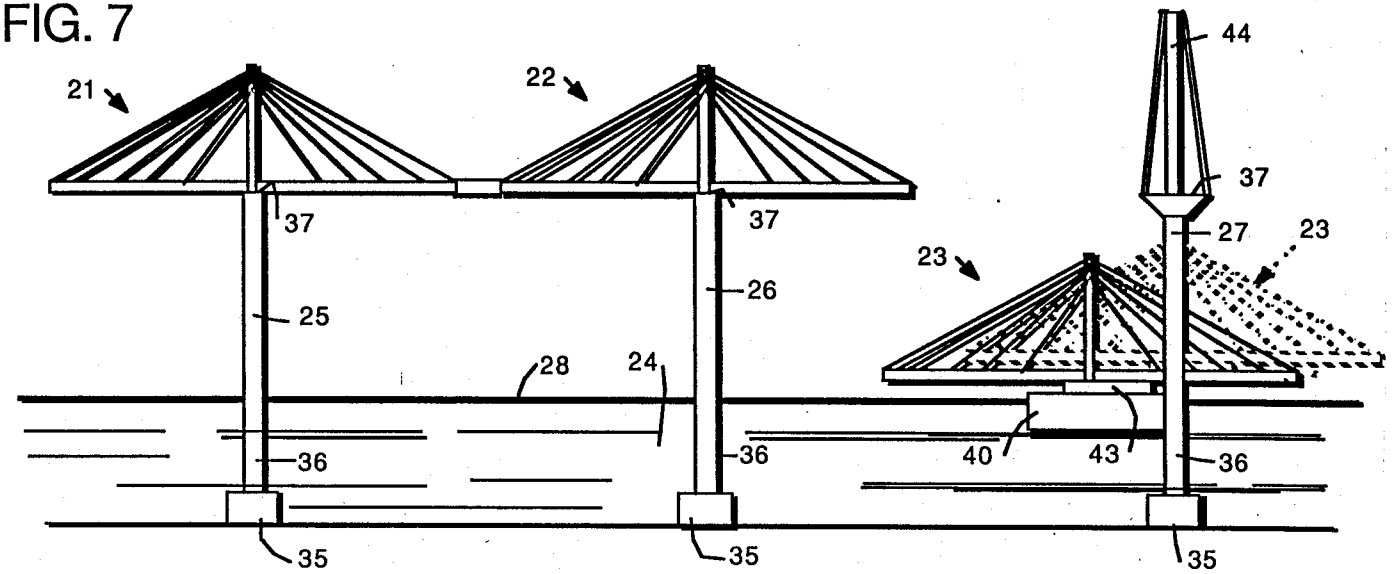
FIG. 7 is a somewhat diagrammatic view in side elevation, its solid-line portion corresponding to FIG. 5 as to the position of the piers, barge, and spans, and dotted lines show the new span in positions corresponding to FIGS. 5 and 6.
Figure 8:
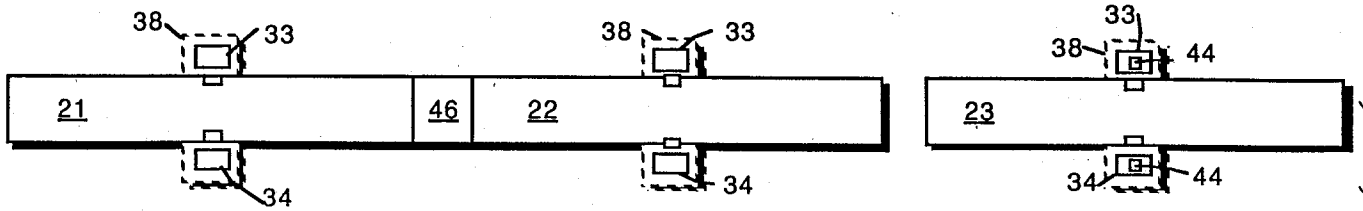
FIG. 8 is a top plan diagrammatic view with the new span aligned longitudinally with respect to the slotted pier, (as in FIG. 6 and in dotted lines in FIG. 7) and then raised by the jacking structure; the barge has been withdrawn.
Figure 11:
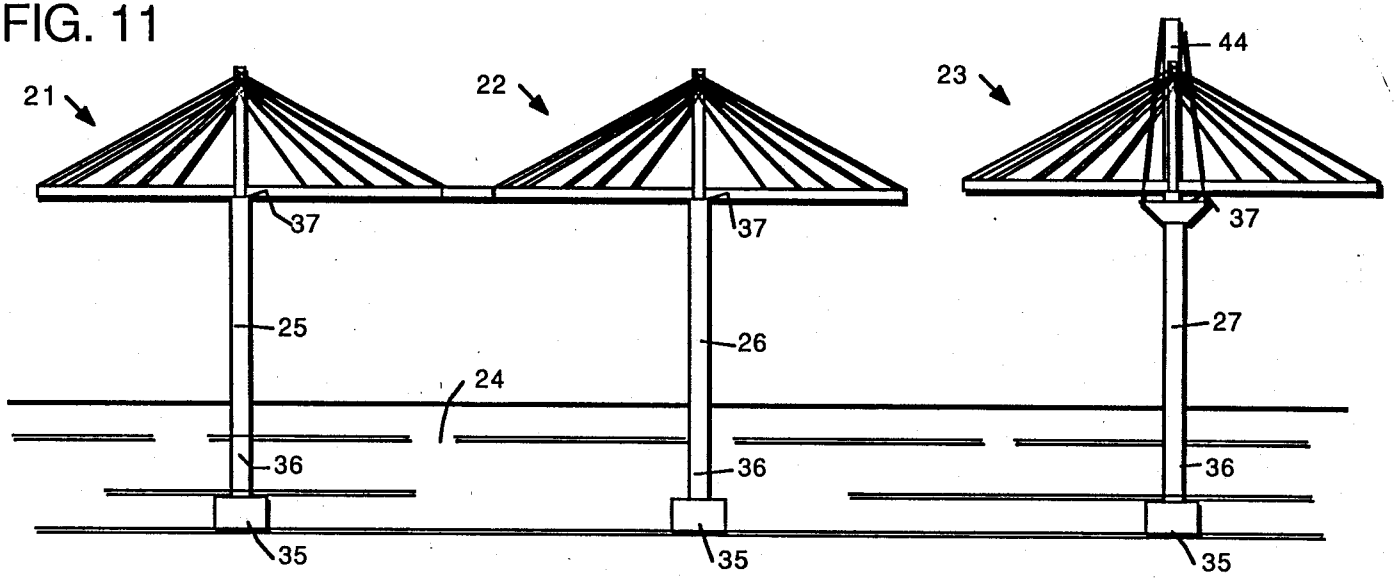
FIG. 11 is a view in side elevation corresponding to the position shown in FIG. 8, with the new span fully raised and ready to be lowered to its ultimate position; its mid-span girders are not yet in place.
Figure 12:
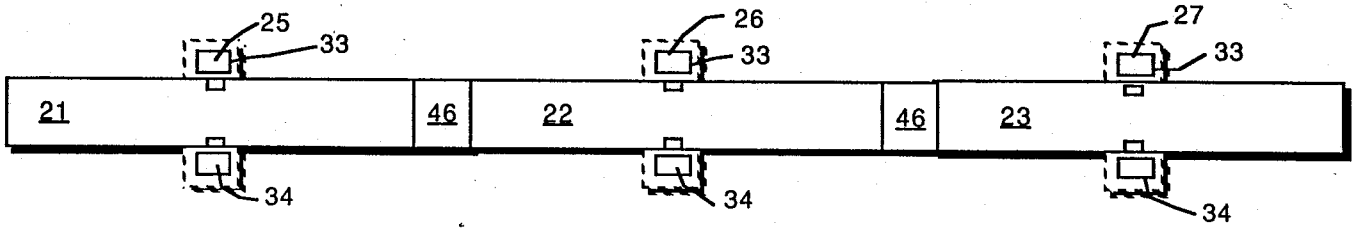
FIG. 12 is a diagrammatic plan view showing the completed bridge after the span has been lowered into place from the FIG. 10 position and the mid-span girders installed.

As shown in FIG. 6, the barge 40 is then moved further toward the pier 27, with the span 23 moving further in between the two portions 33 and 34 of the pier 27, all in proper alignment, and this is continued until the barge 40 bears against the pier fenders 38. At this point a skid beam 43 (See FIG. 10) is installed, as is a jacking structure 44, if not already in place (FIGS. 3, 7, and 10).

The bridge span 23 is then pushed forward and centered longitudinally of the slot 42 and is raised by the centerhole jacks 44. This raising continues until the span 23 rises (FIGS. 10 and 11) above the platform 37 on the pier 27. At this stage, cross girders 45 (FIG. 9) are installed on the top of the pier 27 underneath the span 23. The span 23 is then lowered to rest on the cross girders 45, and the jacking structure 44 is removed. The towers 31 of the span 23 then rest on top of the support members 37 of the respective pier portions 33 and 34.

The final step (See FIG. 12) is to install midspan girders 46 and a deck portion 48 to connect the span 23 to the span 21 and midspan girders 47, which has a deck portion to connect the span 22 to the span 23. Then, the installation is completed.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A method of constructing a bridge over water, comprising positioning a bridge span longitudinally in a position through a lengthwise slot in a bridge pier, moving the span laterally through the slot to a position in the center of the pier at low level, hoisting the span up to its correct position.

2. The method of claim 1 wherein said hoisting step is preceded by placing jacks under the span and directly above the top of the pier and then employing the jacks in the hoisting step.

3. A method of bridge construction, comprising erecting a bridge pier at a bridge site across a body of water, the pier being composed of two portions with a span-accepting slot between them along the longitudinal centerline of said pier, the two portions being joined together at a predetermined level above the surface of the body of water, with the combined pier secured to, and rising from a foundation to a horizontal deck-support platform portion, meanwhile, at a locus distant from said bridge site, making a complete span having a deck and adapted to fit through said slot, a pair of towers on opposite sides of the deck at its longitudinal midpoint for resting on the support platforms of the pier, and a series of span-supporting cables secured to the towers at their upper ends and to the span's deck at their lower ends, when the pier and span have been completed, transporting the span by barge along said body of water to a locus adjacent the bridge site, maneuvering the barge and span so that the span is aligned with the slot of said pier, inserting the span through the slot of the pier, centering said span relative to said pier, jacking said span up to a locus above said deck-support platform, placing a cross girder underneath the span, resting its towers on the pier portion and said deck on said cross-girder, and securing the span with the deck to the pier.

4. A method of bridge construction, comprising erecting a bridge pier at a bridge site across a body of water, the pier being composed of two portions with a span-accepting slot between them along the longitudinal centerline of said pier, the two portions being joined together at a predetermined level above the surface of the body of water, with the combined pier secured to, and rising form a foundation to a horizontal deck-support platform portion, meanwhile, at a locus distant from said bridge site, making a complete span having a deck and adapted to fit through said slot, a pair of towers on opposite sides of the deck at its longitudinal midpoint for resting on the support platforms of the pier, and a series of span-supporting cables secured to the towers at their upper ends and to the span's deck at their lower ends, when the pier and span have been completed, transporting the span by barge along said body of water to a locus adjacent the bridge site and, in said transporting step aligning said span with and centering it on the longitudinal axis of said barge, manueuvering the barge and span so that the span is aligned with the slot of said pier, said maneuvering step including swivelling said span 90° relatively to said barge, inserting the span through the slot of the pier, centering said span relative to said pier, jacking said span up to a locus above said deck-support platform, placing a cross girder underneath the span, resting its towers on the pier portion and said deck on said cross-girder, and securing the span with the deck to the pier.

5. The method of claim 4 wherein between said inserting and centering steps there is the step of inserting a skid girder beneath said span and over said barge.

6. A bridge-building method comprising (1) erecting at a bridge site across a body of water a bridge pier composed of two pier portions with a span-accepting slot between, said slot lying along the bridge centerline, each said two pier portions being joined together as a combined pier portion at a predetermined level above the low-water level of said body of water, with the combined pier portion resting on an underwater footing the vertical pier portions resting on, secured to, and rising from said footing to a deck-support platform, (2) making at a locus distant from said bridge site, a complete span having a deck adapted to fit through said slot, a pair of towers on opposite sides of the deck at its midpoint for resting on said support platforms, and a series of span-supporting cables secured to said tower at their upper ends and to the span's deck at their lower ends, (3) transporting, by a barge having a longitudinal axis, along said body of water, said span to a locus adjacent said bridge site, said span during transport being aligned with and centered on the longitudinal axis of said barge, (4) aligning said barge and span so that said span is aligned with the slot of said pier, (5) inserting said span through said slot, (6) centering said span upon said pier, (7) lifting said span up and resting its said towers on said deck-support platform, and (8) securing said span to said pier with said deck at the proper level.

7. A bridge-building method comprising (1) erecting at a bridge site across a body of water a bridge pier composed of two pier portions with a span-accepting slot between, said slot lying along the bridge centerline, each said two pier portions being joined together as a combined pier portion at a predetermined level above the low-water level of said body of water, with the combined pier portion resting on an underwater footing, the vertical pier portions resting on, secured to, and rising from said footing to a deck-support platform, (2) making at a locus distant from said bridge site, a complete span having a deck adapted to fit through said slot, a pair of towers on opposite sides of the deck at its midpoint for resting on said support platforms, and a series of span-supporting cables secured to said tower at their upper ends and to the span's deck at their lower ends, (3) transporting, by a barge having a longitudinal axis, along said body of water, said span to a locus adjacent to said bridge site, said span during transport being aligned with and centered on the longitudinal axis of said barge, said span being supported on said barge during said transporting step by swivelling means, (4) aligning said barge and span so that said span is aligned with the slot of said pier, (5) inserting said span through said slot, (6) centering said span upon said pier, (7) lifting said span up and resting its said towers on said deck-support platform, and (8) securing said span to said pier with said deck at the proper level, after said transporting step (3) and before said inserting step (5) as part of said aligning step (4), swinging said span on said swivelling means to move said span 90° so that it lies laterally centered across said barge.

8. The method of claim 7 in which between said inserting step (5) and said centering step (6), there is the step of inserting a skid girder below said span's deck.

9. The method of claim 7 wherein there is the step of installing a lifting jack on said pier prior to the lifting step (7) and then, after said lifting step (7), removing said jack from said pier.

10. The method of claim 7 as applied to bridges having adjacent piers and spans, wherein after said securing step (8) there is the step (9) of inserting and connecting deck portions between the newly inserted span to the adjacent spans.

11. A bridge or bridge segment comprising a pair of pier portions with a span-accepting slot between them, each said two pier portion being joined together as a combined pier portion at a predetermined level above the low-water level of said body of water, with the combined pier portion resting on an underwater footing and a vertical pier portion resting on, secured to, and rising from said footing to a deck-support platform, a bridge span having a deck extending through said slot and centered with respect thereto, a pair of towers on opposite sides of the deck at its midpoint for resting on said support platforms, and a series of span-supporting cables secured to said towers at their upper ends and the span's deck at their lower ends, whereby said span can be prefabricated, transported by a barge having a longitudinal axis, along a body of water, to a locus adjacent said bridge site, inserted through said slot and centered said span relative to said pier portions, and then raised up so that said towers rest on said pier portions, and said span is secured to said pier portions with said deck at the proper level.

12. A method of bridge construction comprising erecting a bridge pier at a bridge site across a body of water, the pier being composed of two portions with a span-accepting slot between them along the longitudinal centerline of said pier, the two portions being joined together at a predetermined level above the surface of the body of water, with the combined pier secured to, and rising from a foundation to a horizontal deck-support platform portion, meanwhile, at a locus distant from said bridge site, making a complete span having a deck and adapted to fit through said slot, when the pier and span have been completed, transporting the span by barge along said body of water to a locus adjacent the bridge site, and, in said transporting step aligning said span with and centering it on the longitudinal axis of said barge, maneuvering the barge and span so that the span is aligned with the slot of said pier, said maneuvering step includes a swivelling said span 90° relatively to said barge, inserting the span through the slot of the pier, centering said span relative to said pier, jacking said span up to a locus above said deck-support platform, placing a cross girder underneath the span, and securing the span with the deck to the pier.

13. The bridge building method comprising (1) erecting at a bridge site across a body of water a bridge pier composed of two pier portions with a span-accepting slot between, said slot lying along the bridge centerline, each said two pier portions being joined together as a combined pier portion at a predetermined level above the low-water level of said body of water, with the combined pier portion resting on an underwater footing, the vertical pier portions resting on, secured to, and rising from said footing to a deck-support platform, (2) making at a locus distant from said bridge site, a complete span having a deck adapted to fit through said slot, (3) transporting, a by a barge having a longitudinal axis, along said body of water, said span to a locus adjacent to said bridge site, said span during transport being aligned with and centered on the longitudinal axis of said barge, said span is being supported on said barge during said transporting step by swivelling means, (4) aligning said barge and span so that said span is aligned with the slot of said pair, after said transporting step (3) and before said inserting step as part of said aligning step (4), swinging said span on said swivelling means to move said span 90° so that it lies laterally centered across said barge.

* * * * *